US011437173B2

(12) United States Patent
Kim et al.

(10) Patent No.: US 11,437,173 B2
(45) Date of Patent: Sep. 6, 2022

(54) COIL COMPONENT

(71) Applicant: SAMSUNG ELECTRO-MECHANICS CO., LTD., Suwon-si (KR)

(72) Inventors: Jae Hun Kim, Suwon-si (KR); Seong Min Cho, Suwon-si (KR); Eo Jin Choi, Suwon-si (KR); Young Ku Lyu, Suwon-si (KR); Yong Hui Li, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 722 days.

(21) Appl. No.: 16/008,584

(22) Filed: Jun. 14, 2018

(65) Prior Publication Data

US 2019/0074126 A1 Mar. 7, 2019

(30) Foreign Application Priority Data

Sep. 5, 2017 (KR) ..... 10-2017-0113142

(51) Int. Cl.
*H01F 5/00* (2006.01)
*H01F 17/00* (2006.01)
(Continued)

(52) U.S. Cl.
CPC ..... *H01F 17/0013* (2013.01); *H01F 17/04* (2013.01); *H01F 27/2804* (2013.01);
(Continued)

(58) Field of Classification Search
CPC .. H01F 17/0013; H01F 17/04; H01F 27/2804; H01F 27/292; H01F 27/27324; H01F 2017/0066; H01F 2017/048
(Continued)

(56) References Cited

U.S. PATENT DOCUMENTS 4,494,100 A * 1/1985 Stengel ..... H01F 5/003 336/200
4,794,358 A * 12/1988 Steingroever ..... H01F 5/00 335/299
(Continued)

FOREIGN PATENT DOCUMENTS

CN 105280336 A 1/2016
CN 106486267 A 3/2017
(Continued)

OTHER PUBLICATIONS

Office Action issued in corresponding Chinese Patent Application No. 201810889025.X dated Oct. 10, 2020, with English translation.
(Continued)

*Primary Examiner* — Elvin G Enad
*Assistant Examiner* — Joselito S. Baisa
(74) *Attorney, Agent, or Firm* — Morgan, Lewis & Bockius LLP

(57) ABSTRACT

A coil component includes a body, a coil portion embedded in the body, and external electrodes electrically connected to the coil portion. The coil portion includes coil patterns having trenches formed in surfaces thereof. The trenches extend through a partial thickness of the coil portion, and are located at aligned locations in adjacent windings of the coil portion. A method of forming the coil component includes forming a mask pattern having a coil shaped opening and including a plurality of bridges extending across the coil shaped opening in the mask pattern.

20 Claims, 7 Drawing Sheets

(51) Int. Cl.
*H01F 17/04* (2006.01)
*H01F 27/28* (2006.01)
*H01F 27/29* (2006.01)
*H01F 27/32* (2006.01)

(52) U.S. Cl.
CPC ..... *H01F 27/292* (2013.01); *H01F 27/324* (2013.01); *H01F 2017/0066* (2013.01); *H01F 2017/048* (2013.01); *H01F 2027/2809* (2013.01)

(58) Field of Classification Search
USPC ..... 336/200
See application file for complete search history.

(56) References Cited

U.S. PATENT DOCUMENTS 5,015,972 A * 5/1991 Cygan ..... H03H 7/38 333/26
5,111,169 A * 5/1992 Ikeda ..... H03H 7/427 333/181
5,363,081 A * 11/1994 Bando ..... H01F 17/0006 29/602.1
5,369,249 A * 11/1994 Kwon ..... H05B 6/1245 219/624
6,002,161 A * 12/1999 Yamazaki ..... H01L 23/645 257/531
6,315,914 B1 11/2001 Silverbrook
6,380,834 B1 4/2002 Canzano et al.
7,084,728 B2 * 8/2006 Hyvonen ..... H01L 23/5225 336/84 C
7,948,346 B2 * 5/2011 Hebert ..... H01F 17/0033 336/200
8,193,893 B2 * 6/2012 Erturk ..... H01F 17/0006 336/200
8,242,872 B2 * 8/2012 Lim ..... H01F 27/2804 336/200
9,142,343 B2 * 9/2015 Ohkubo ..... H01F 27/255
9,230,725 B2 * 1/2016 Erturk ..... H01L 23/5227
9,894,768 B2 * 2/2018 Kim ..... H01F 17/0013
10,553,353 B2 * 2/2020 Vanukuru ..... H01F 17/0013
10,736,214 B2 * 8/2020 Wölfel ..... H05K 1/0296
10,847,298 B2 * 11/2020 Kudo ..... H01F 27/24
2002/0130751 A1 * 9/2002 Chow ..... H01F 27/306 336/199
2008/0284553 A1 * 11/2008 Lim ..... H01F 27/006 336/200
2015/0155084 A1 * 6/2015 Kim ..... H01F 41/046 174/260
2016/0163444 A1 6/2016 Choi et al.
2016/0351316 A1 12/2016 Ohkubo et al.
2016/0357314 A1 * 12/2016 Liu ..... G02F 1/13338
2017/0323851 A1 11/2017 Wei
2018/0114631 A1 * 4/2018 Ida ..... H01F 27/324

FOREIGN PATENT DOCUMENTS

CN 107275058 A 10/2017
CN 107437457 A 12/2017
CN 208796806 U * 4/2019
CN 107993791 B * 5/2020 ..... H01B 3/30
JP 2006-032579 A 2/2006
JP 2016-004928 A 1/2016
JP 2016-225465 A 12/2016
KR 10-1598295 B1 2/2016

OTHER PUBLICATIONS

Korean Office Action issued in corresponding Korean Patent Application No. 10-2017-0113142, dated Sep. 8, 2018, with English Translation.
Office Action issued in corresponding Chinese Patent Application No. 201810889025.X dated Jun. 7, 2021, with English translation.

* cited by examiner

COIL COMPONENT

CROSS-REFERENCE TO RELATED APPLICATION(S)

This application claims benefit of priority to Korean Patent Application No. 10-2017-0113142 filed on Sep. 5, 2017 in the Korean Intellectual Property Office, the disclosure of which is incorporated herein by reference in its entirety.

BACKGROUND

1. Field

The present disclosure relates to a coil component.

2. Description of Related Art

In accordance with miniaturization and thinning of electronic devices such as digital televisions (TVs), mobile phones, laptop computers, and the like, demand has developed for the miniaturization and thinning of coil components used in these electronic devices. In order to satisfy such a demand, research and development of various winding type or thin film type coil components have been actively conducted.

A main difficulty in miniaturizing and thinning of the coil components is maintaining characteristics equal to characteristics of an existing coil component in spite of the miniaturization and thinning. In order to satisfy this demand, a sufficient size of a core in which a magnetic material is filled and a low direct current (DC) resistance $R_{dc}$ generally need to be secured. To this end, development progresses of products having increased aspect ratios of coil patterns and cross-sectional areas of coil portions, such as products made using anisotropic plating technology.

Meanwhile, when the aspect ratio of the coil pattern is increased, stability of the coil pattern needs to be secured in a manufacturing process. When the stability of the coil pattern is decreased, the coil pattern may be bent or may collapse.

SUMMARY

An aspect of the present disclosure may provide a coil component including a coil pattern having improved structural stability in spite of having a high aspect ratio.

According to an aspect of the present disclosure, a coil component may include a body, a coil portion embedded in the body and including a coil pattern having trenches formed in surfaces thereof, and external electrodes electrically connected to the coil portion.

A plurality of coil pattern may include a plurality of turns, and trenches in adjacent turns of the coil pattern may be aligned with each other.

Multiple trenches may be formed in different regions of the coil pattern.

The trenches may be disposed at symmetrical locations with respect to a center line of the body.

Alternatively, the trenches may be disposed at asymmetrical locations with respect to a center line of the body.

The coil component may further include a support member supporting the coil portion, and the trench may be formed in a surface of the coil patterns opposing a surface of the coil pattern facing the support member.

Coil patterns may be disposed on opposite surfaces of the support member.

The trenches may be filled with a material constituting the body.

The coil component may further include an insulating layer covering the coil pattern, and the trenches may be filled with a material constituting the insulating layer.

A depth of the trench may be a half or less of a thickness of the coil pattern.

An aspect ratio of the coil pattern may be 3 to 20.

The coil pattern may have a multilayer structure.

According to another aspect of the present disclosure, a coil component may include a support member and a coil disposed on a surface of the support member. The coil includes a plurality of trenches disposed in a surface of the coil facing away from the support member.

The coil may have a thickness measured orthogonally to the surface of the support member, and a width measured orthogonally to the thickness. Each trench of the plurality of trenches may extend through a partial thickness of the coil and through an entire width of the coil.

Each trench of the plurality of trenches may extend through less than half of a thickness of the coil.

The coil may include a plurality of turns disposed on the surface of the support member, and each trench of the plurality of trenches may extend through all turns of the plurality of turns of the coil at locations aligned with each other.

The coil component may include a body formed of a magnetic material dispersed in a resin, the coil may be embedded in the body, and the body may extend into the trenches of the plurality of trenches.

The coil component may include an insulating layer formed of an insulating material, the coil may be embedded in the insulating layer, and the insulating layer may extend into the trenches of the plurality of trenches.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will be described in detail with reference to the accompanying drawings.

Electronic Device

Figure 1:
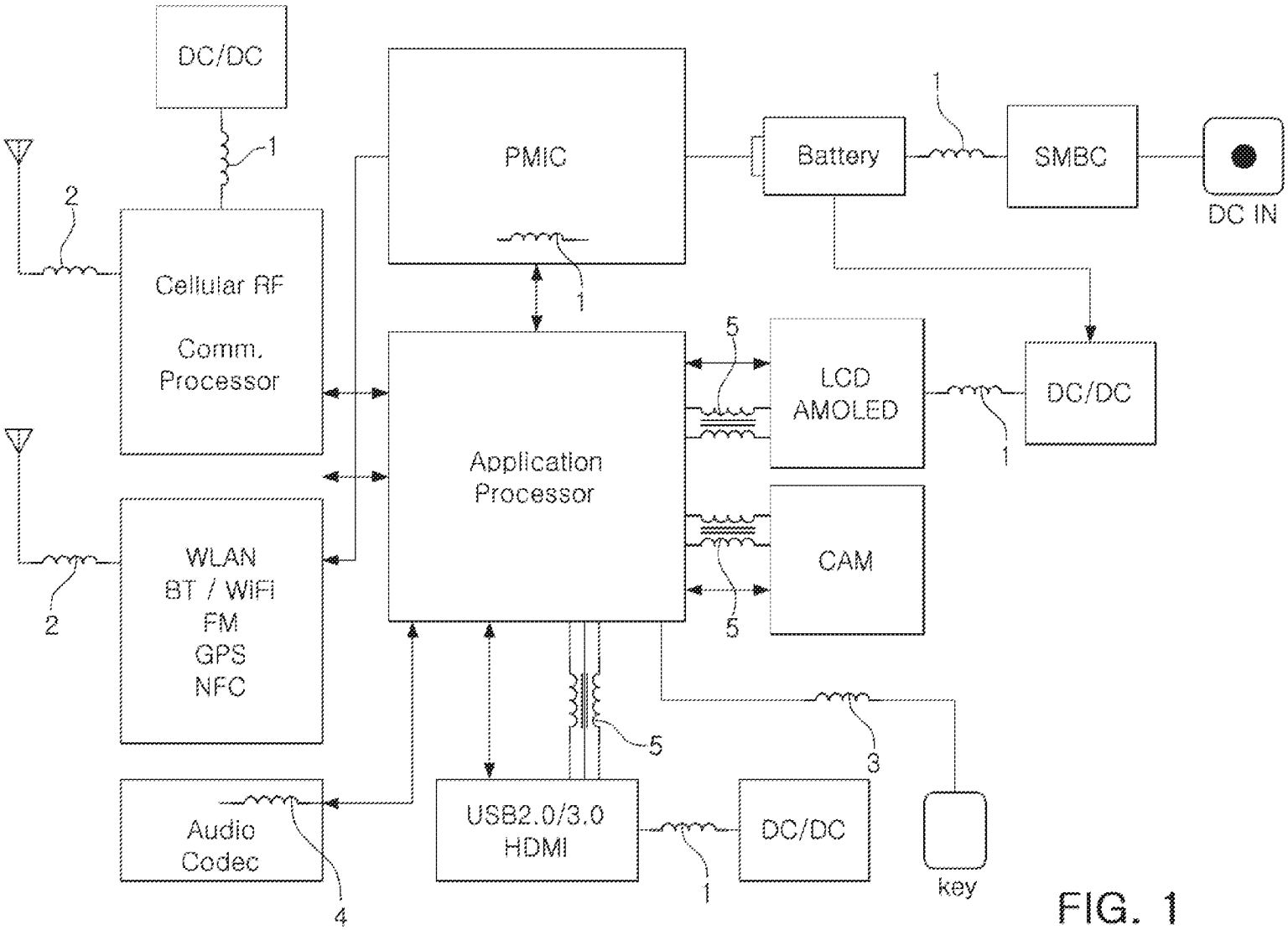
FIG. 1 is a schematic view illustrating examples of coil components used in electronic devices.

FIG. 1 is a schematic view illustrating various examples of coil components used in an electronic device.

Referring to FIG. 1, it may be appreciated that various kinds of electronic components including coil components are used in an electronic device. For example, an application processor, a direct current (DC) to DC converter, a communications (Comm.) processor, a wireless local area network (WLAN) device, a Bluetooth (BT) device, a wireless fidelity (WiFi) device, a frequency modulation (FM) device, a global positioning system (GPS) device, a near field communications (NFC) device, a power management integrated circuit (PMIC), a battery, a switched-mode battery charger (SMBC), a liquid crystal display (LCD), an active matrix organic light emitting diode (AMOLED) device, an audio codec, a universal serial bus (USB) 2.0/3.0 device, a high definition multimedia interface (HDMI), a camera or webcam (CAM), and the like, may be used. Here, various kinds of coil components may be appropriately used in or between these electronic components depending on their purposes in order to remove noise, or the like. For example, one or more of a power inductor 1, high frequency (HF) inductor 2, a general bead 3, a bead 4 for a high frequency (GHz), common mode filters 5, and the like, may be used.

In detail, the power inductor 1 may be used to store electricity in a magnetic field form to maintain an output voltage, thereby stabilizing power. In addition, the high frequency (HF) inductor 2 may be used to perform impedance matching to secure a required frequency or cut off noise and/or an alternating current (AC) component. Further, the general bead 3 may be used to remove noise of power and signal lines or remove a high frequency ripple. Further, the bead 4 for a high frequency (GHz) may be used to remove high frequency noise of a signal line and a power line related to an audio. Further, the common mode filter 5 may be used to pass a current therethrough in a differential mode and remove only common mode noise.

An electronic device may be typically a smartphone, but is not limited thereto. The electronic device may also be, for example, a personal digital assistant, a digital video camera, a digital still camera, a network system, a computer, a monitor, a television, a video game, a smartwatch, or the like. The electronic device may also be various other electronic devices, in addition to the devices described above.

Coil Component

Hereinafter, a coil component will be described, particularly an inductor for convenience of explanation. However, the coil component according to the present disclosure may also be used as the coil components for various purposes as described above.

Figure 2:
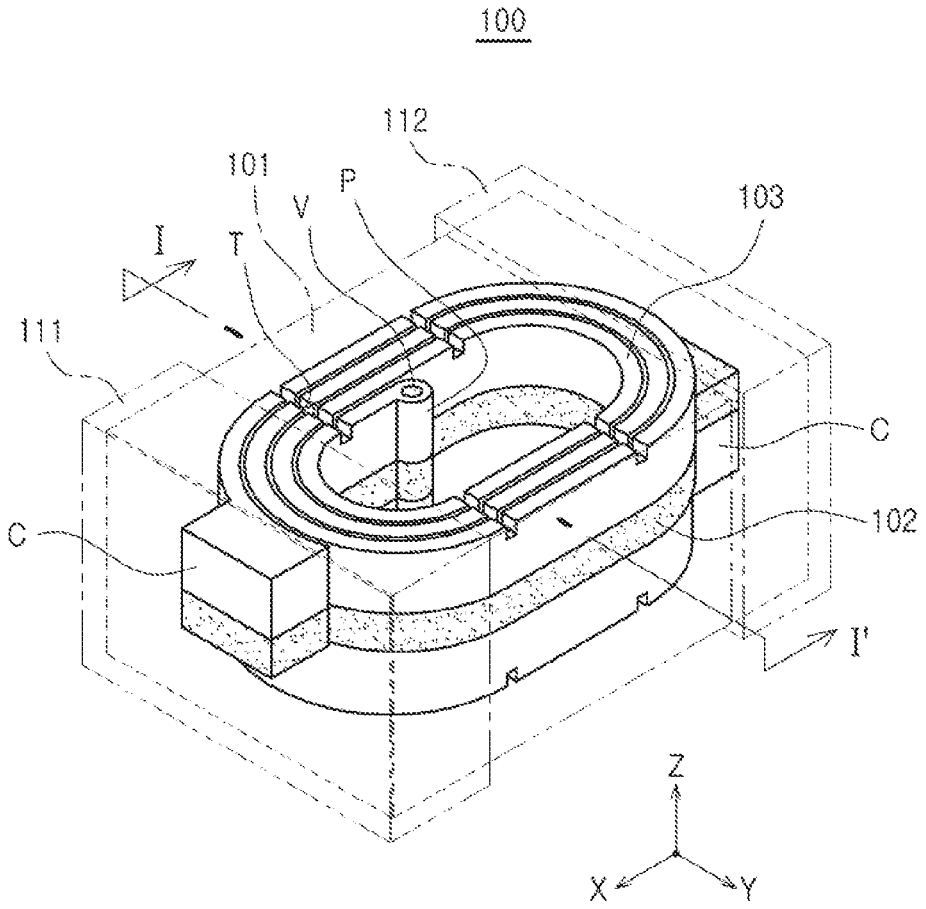
FIG. 2 is a schematic perspective view illustrating a coil component according to an exemplary embodiment.
Figure 3:
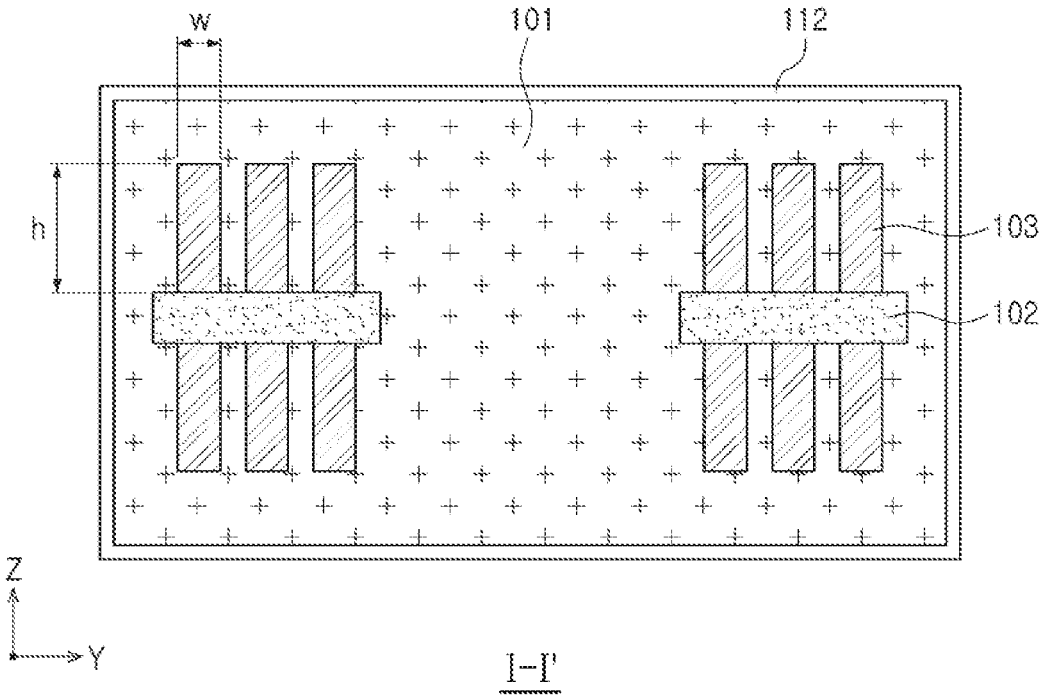
FIG. 3 is a schematic cross-sectional view taken along line I-I' of the coil component of FIG. 2.
Figure 4:
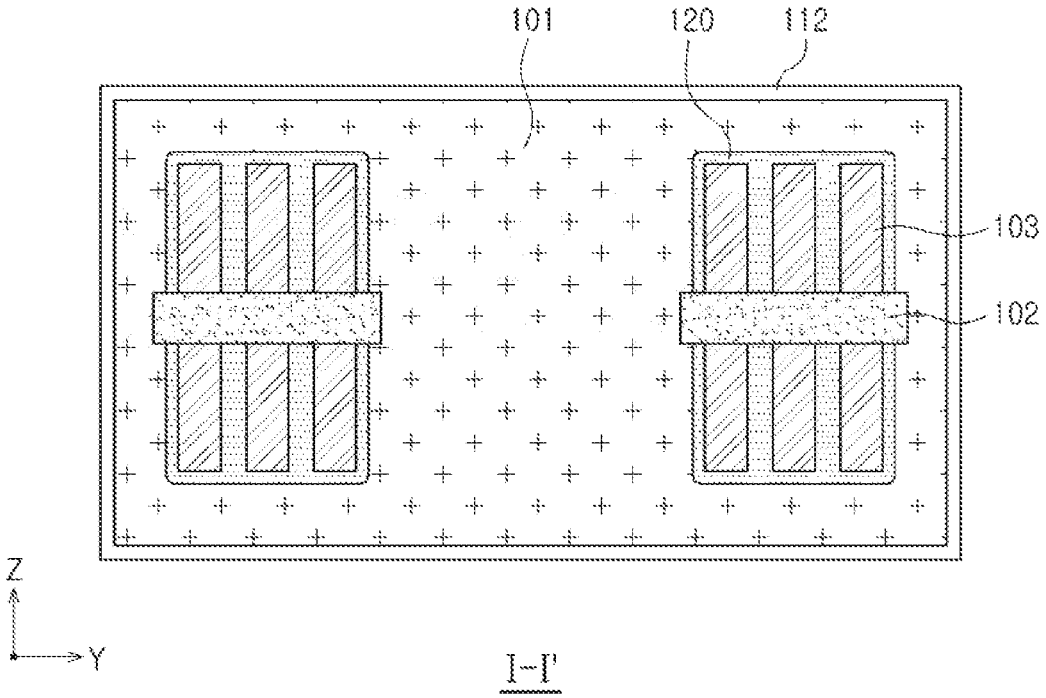
FIG. 4 is a cross-sectional view illustrating a coil component according to a modified embodiment.
Figure 5:
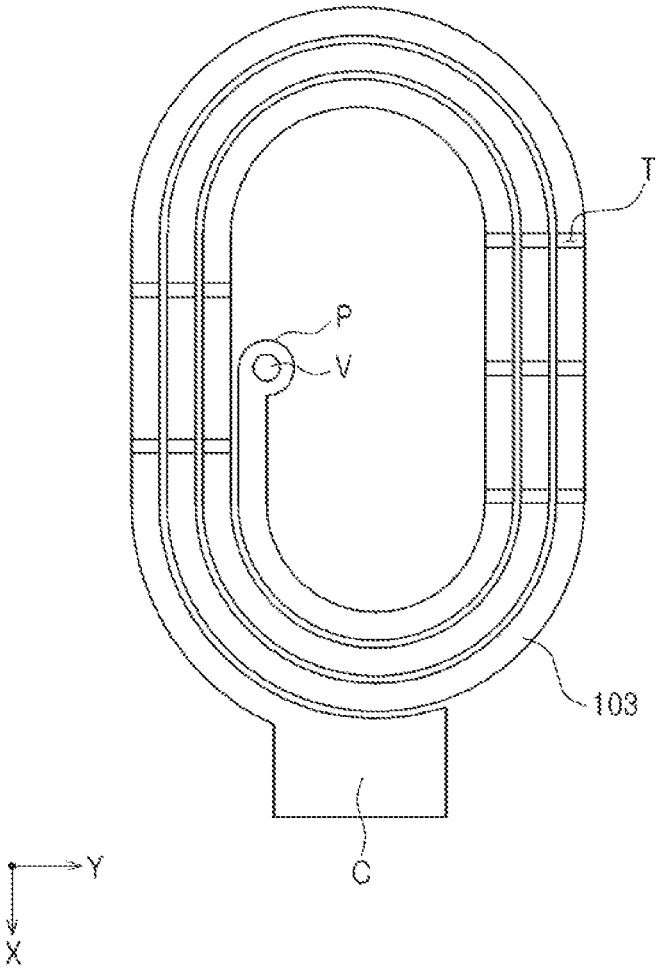
FIG. 5 is a plan view illustrating a form of a coil pattern in a coil component according to another modified example.

FIG. 2 is a schematic perspective view illustrating an appearance of a coil component according to an exemplary embodiment. In addition, FIG. 3 is a cross-sectional view taken along line I-I' of FIG. 1. FIG. 4 is a cross-sectional view illustrating a coil component according to a modified embodiment. FIG. 5 is a plan view illustrating a form of a coil pattern in a coil component according to another modified example.

Referring to FIGS. 2 and 3, a coil component 100 according to an exemplary embodiment may include a body 101, a coil portion 103, and external electrodes 111 and 112. In addition, a support member 102 supporting the coil portion 103 may be included in the body 101.

The body 101 may include the coil portion 103 and a magnetic material disposed in the vicinity of the coil portion 103. As an example of such a magnetic material, there may be ferrite or metal magnetic particles filled in a resin. In this case, the ferrite may be a material such as Mn—Zn based ferrite, Ni—Zn based ferrite, Ni—Zn—Cu based ferrite, Mn—Mg based ferrite, Ba based ferrite, Li based ferrite, or the like. In addition, the metal magnetic particle may include one or more selected from the group consisting of iron (Fe), silicon (Si), chromium (Cr), aluminum (Al), and nickel (Ni). For example, the metal magnetic particle may be a Fe—Si—B—Cr based amorphous metal, but is not limited thereto. The metal magnetic particle may have a diameter of about 0.1 μm to 30 μm. The body 101 may have a form in which the ferrite or the metal magnetic particles are dispersed in a thermosetting resin such as an epoxy resin, a polyimide resin, or the like.

As illustrated in FIG. 3, in the present exemplary embodiment, the coil portion 103 may be embedded in the body 101, and may include coil patterns having trenches T formed in surfaces thereof. The coil portion 103 may perform various functions in the electronic device through characteristics appearing from a coil of the coil component 100. For example, the coil component 100 may be a power inductor. In this case, the coil portion 103 may serve to store electricity in a magnetic field form to maintain an output voltage, resulting in stabilization of power. In this case, coil patterns constituting the coil portion 103 may be stacked and disposed on opposite surfaces of the support member 102, respectively, and may be electrically connected to each other through a conductive via V penetrating through the support member 102. In addition, a pad portion P may be formed in a region of the coil portion 103 connecting the coil patterns each formed on the opposite surfaces of the support member 102 to each other.

The coil portion 103 may be formed in a spiral shape and have a plurality of turns. In detail, the plurality of turns of the coil portion 103 may be formed by connecting a plurality of coil patterns, each having at least one turn, to each other. The coil portion 103 may include lead portions C formed at the outermost portions of the plurality of the turns. The lead portions C may be exposed to the outside of the body 101 for the purpose of electrical connection to the external electrodes 111 and 112. In this case, the lead portions C may be formed to have a thickness smaller than that of other regions of the coil portion 103, that is, regions corresponding to the coil patterns.

The coil pattern may have a shape in which a ratio of a height h to a width w of the coil pattern, that is, an aspect ratio of the coil pattern is high (e.g., h may be larger than w) in order to increase a cross-sectional area of the coil portion 103 within a limited space. For example, a high aspect ratio of the coil pattern may be about 3 to 20 (e.g., h may be 3 to 20 times larger than w). When the aspect ratio of the coil pattern is high, a mask used in a plating process, or the like, needs to have structural stability in order to improve stability of the coil pattern in a manufacturing process. In the present exemplary embodiment, the trenches T may be formed in the surfaces of the coil patterns, and may correspond to regions in which bridges connecting adjacent mask patterns to each other are formed.

The support member 102 supporting the coil portion 103 may be formed of a polypropylene glycol (PPG) substrate, a ferrite substrate, a metal based soft magnetic substrate, or the like. In this case, a through-hole may be formed in a central region of the support member 102, and a magnetic material may be filled in the through-hole to form a core region. The core region may constitute a portion of the body 101. As described above, the core region having a form in which the magnetic material is filled may be formed to improve performance of the coil component 100.

The external electrodes 111 and 112 may be formed on the body 101 to be connected to the lead portions C, respectively. The external electrodes 111 and 112 may be formed of a paste including a metal having excellent electrical conductivity, such as a conductive paste including nickel (Ni), copper (Cu), tin (Sn), or silver (Ag), or alloys thereof. In addition, plating layers (not illustrated) may further be formed on the external electrodes 111 and 112. In this case, the plating layers may include one or more selected from the group consisting of nickel (Ni), copper (Cu), and tin (Sn). For example, nickel (Ni) layers and tin (Sn) layers may be sequentially formed in the plating layers.

As described above, in the present exemplary embodiment, the trenches T may be formed on the surfaces of the coil patterns constituting the coil portion 103. In detail, the trenches T may be formed in surfaces of the coil patterns disposed opposite to surfaces of the coil patterns facing the support member 102, and both of the coil patterns formed on the opposite surfaces of the support member 102 may have the trenches T. A form of the trenches T will be described in more detail. As illustrated in FIG. 2, adjacent turns of the plurality of turns of one of the coil patterns of the plurality of coil patterns may have a form in which the trenches T extend therebetween. In addition, the trenches T may be formed in a plurality of regions of the surfaces of the coil patterns. In addition, a plurality of trenches T may have a symmetrical structure in relation to a center line of a width of the body 101 along X direction. The trenches T may be filled with a material constituting the body 101, and coupling force between the body 101 and the coil portion 103 may be improved by such a form, such that structural stability of the coil portion 103 may further be improved.

As described below in connection with processes of manufacturing a coil component, mask patterns having a high aspect ratio may be used in order to manufacture coil patterns having a high aspect ratio by a plating process, or the like. In this case, the mask patterns remain in a partition wall form between void regions in which the coil patterns are formed, and have the high aspect ratio. Because of the high aspect ratio, it is generally difficult to secure structural stability of the mask patterns, such that the coil patterns may be bent or collapse. In the present exemplary embodiment, the bridges that may connect the mask patterns to each other may be formed at upper portions of the mask patterns of the void regions, and the trenches T corresponding to bridge regions may remain in the coil patterns obtained using the mask patterns. Therefore, structural stability of mask patterns and of the formed coil portion 103 to which the trenches T are applied may be improved. Shapes of the trenches T may depend on that of the bridges connecting the mask patterns to each other, and a form, a depth, or the like, of the trenches T may be appropriately controlled in consideration of a structural stability securing function. For example, the depth of the trenches T may be a half or less of a thickness of the coil pattern. When the depth of the trenches T is excessively deep, an electrical resistance of the coil portion 103 may be increased, such that electrical characteristics of the coil component 100 may be deteriorated.

Modified examples will be described with reference to FIGS. 4 and 5. First, a coil component according to another exemplary embodiment illustrated in FIG. 4 may be different from the coil component according to the exemplary embodiment described above in that it further includes an insulating layer 120. The insulating layer 120 may cover the coil patterns to protect the coil patterns. The insulating layer 120 may insulate the coil patterns from the body 101. In this case, the trenches T may be filled with a material constituting the insulating layer 120. The insulating layer 120 may be obtained by coating a material such as oxide, polymer, or the like, on the surfaces of the coil patterns.

Next, a coil component according to another exemplary embodiment illustrated in FIG. 5 may be different from the coil component according to the exemplary embodiment described above in terms of positions of trenches T. As in the present modified example, a plurality of trenches T may have an asymmetrical structure in relation to a center line of width of the body 101 along an X direction (e.g., a line passing through a center of the coil and aligned with the X direction). As described above, positions of the trenches T may be changed depending on positions of the bridge regions connecting the mask patterns to each other, and the trenches T positioned at the left and the right of the coil portion 103 when the coil portion 103 is viewed from above may be arranged in a zigzag form (e.g., at different locations along the X axis), and structural stability of the mask patterns may further be secured. In addition, the trenches T may also be disposed in curved regions that are not linear regions (e.g., in regions in which the coil windings are curved), and/or may be disposed in a pad portion P.

An example of processes of manufacturing the coil component having the structure described above will hereinafter be described with reference to FIGS. 6 through 10, and a method of forming the coil patterns will mainly be described. Structural features of the coil component may be more clearly understood from a description of processes for manufacturing a coil component to be provided below.

Figure 6:
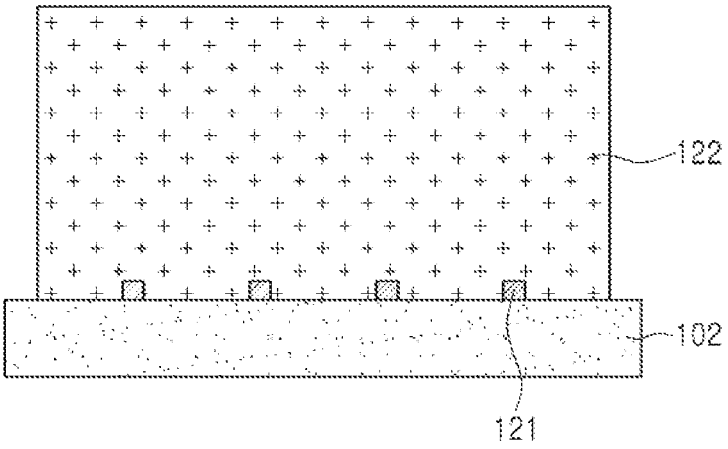
FIGS. 6 through 10 are views illustrating steps of a process for manufacturing a coil component according to an exemplary embodiment.

First, as illustrated in FIG. 6, the support member 102 may be prepared, and a seed layer 121 and a mask 122 of the support member 102 may be formed. The seed layer 121 may be a seed region for forming the coil patterns, and may be an electroless plating layer formed of copper, or the like. In addition, as a process before the mask 122 is patterned in an intended shape, the mask 122 may be formed using a resin such as an epoxy resin, or the like, and may include a photosensitive material for the subsequent patterning process. In this case, the mask 122 may be obtained by performing any molding process or any applying process known in the related art.

Figure 7:
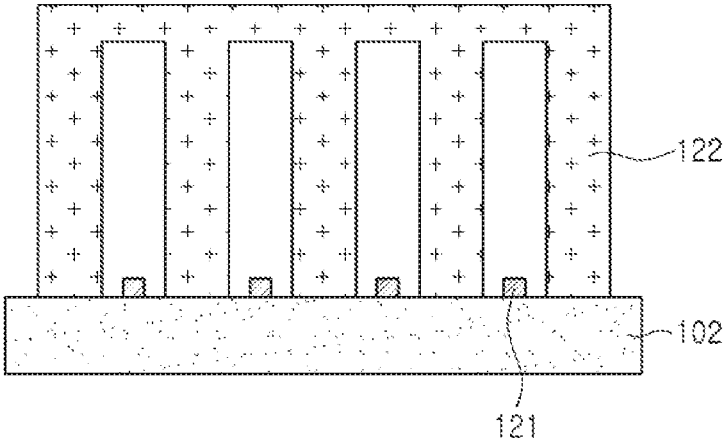
Figure 8:
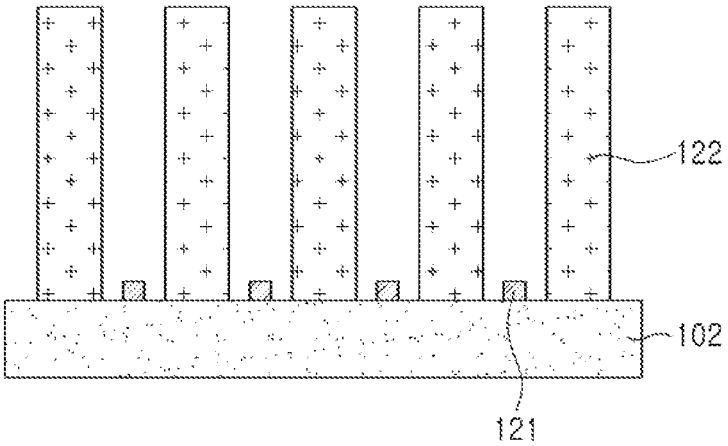

Then, as illustrated in FIGS. 7 and 8, the seed layers 121 may be exposed by removing partial regions of the mask 122. Here, the mask 122 may be appropriately removed in consideration of desired shapes of coil patterns. When portions of the mask are removed and the other portions of the mask remain, the mask pattern 122 corresponding to the remaining portions may basically have a shape of partition walls, and bridges connecting these partition walls to each other may be formed at upper portions of the mask patterns. FIG. 7 illustrates a cross-section in which the bridges are formed in the upper portions of the mask patterns (e.g., a cross-section at a location in which trenches T will be formed), and FIG. 8 illustrates a cross-section in which the upper portions of the mask patterns are opened without the bridges (e.g., a cross-section at a location in which trenches Twill not be formed). In order to form the bridges in only upper portions of the mask patterns 122, an amount of light irradiated to the mask including the photosensitive material in exposure and development processes of the mask may be controlled for each region of the mask. The number and widths of bridges may be changed depending on the shapes of the coil patterns, and a thickness of the bridges corresponding to the depth of the trenches T described above may be controlled by an amount of light irradiated to the mask. In detail, as the amount of light (for example, ultraviolet rays) irradiated to the mask is increased, the thickness of the bridges may be increased, and the depth of the trenches T may thus be also increased.

Figure 9:
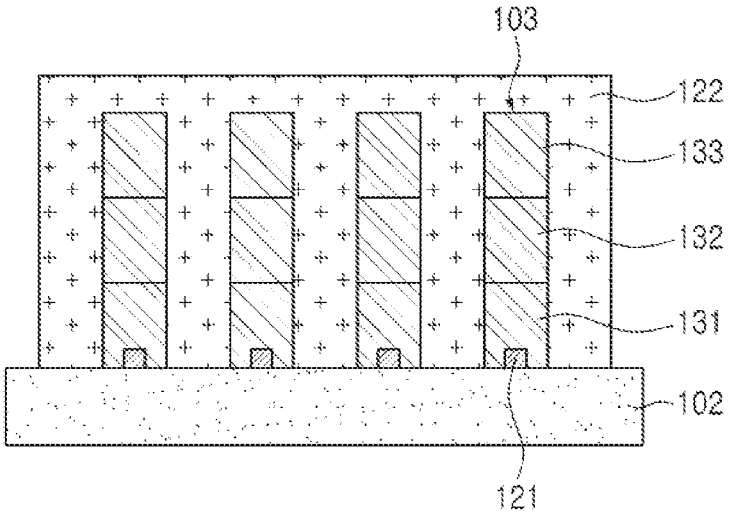

Then, as illustrated in FIG. 9, the coil patterns having a shape corresponding to that of the mask patterns 122 may be formed on the seed layer 121 using the mask patterns 122. The coil patterns may be formed to have a height, measured from the surface of the support member 102, that exceeds a height of a lower surface of the bridges formed in the upper portions of the mask patterns. Since the mask patterns 122 are connected to each other by the bridges, stability of the mask patterns may be enhanced. Therefore, when the mask patterns 122 are used as a mold, even in a case of forming the coil patterns having a high aspect ratio, collapse of the coil patterns may be effectively prevented. FIG. 9 illustrates a form of a cross section in a region in which the upper portions of the mask patterns 122 are connected to each other by the bridges (e.g., at a location in which trenches T are formed in the coil pattern 103), and upper portions of the coil patterns in regions in which the bridges do not exist may be opened.

As described above, the coil patterns constituting the coil portion 103 may have a high aspect ratio so as to have a large cross-sectional area. For example, the coil patterns may have an aspect ratio of about 3 to 20. The coil patterns may have a multilayer structure to have the high aspect ratio as described above. For example, three plating layers 131, 132, and 133 may be sequentially formed by performing a plating process three times. In this case, all of the three plating layers 131, 132, and 133 are not formed by the same plating process or step, but may be formed by an appropriate combination of isotropic plating and anisotropic plating processes.

Figure 10:
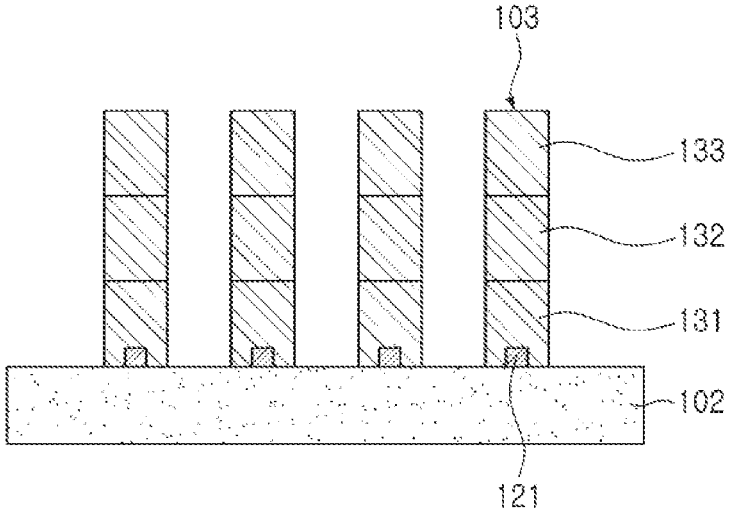

After the coil patterns are formed, the mask patterns 122 may be removed as shown in FIG. 10 by an appropriate process such as an asking process or an etching process. For example, the mask patterns 122 may be removed by laser irradiation. In this case, a process of removing the mask patterns 122 may be performed together with a process of forming a cavity in the support member 102 in order to forma core region. When the mask patterns 122 are removed, the insulating layer 120 may optionally be coated on the surfaces of the coil patterns (see, e.g., FIG. 4), and the body 101, the external electrodes 111 and 112, and the like, may be formed to obtain the coil component 100 having the structure described above (see, e.g., FIGS. 2-5).

As set forth above, in the coil component according to the exemplary embodiment, even in a case in which the coil patterns have the high aspect ratio, structural stability of the coil patterns may be excellent, such that characteristics and reliability of the coil component may be improved.

While exemplary embodiments have been shown and described above, it will be apparent to those skilled in the art that modifications and variations could be made without departing from the scope of the present invention as defined by the appended claims.

What is claimed is:

1. A coil component comprising:

a body;

a coil portion embedded in the body and including a coil pattern having a trench formed therein across an entire line width of the coil pattern; and external electrodes electrically connected to the coil portion, wherein the trench extends to the coil pattern in a thickness direction of the body to define a reduced-thickness portion of the coil pattern, and wherein an uppermost surface of the coil pattern outside the trench is embedded in the body.

2. The coil component of claim 1, wherein the coil pattern has a plurality of turns, the coil pattern includes a plurality of trenches including the trench, the plurality of the trenches are formed in the plurality of the turns of the coil pattern, and trenches of the plurality of the trenches are aligned with each other in adjacent turns of the plurality of the turns of the coil pattern.

3. The coil component of claim 1, wherein the coil pattern includes a plurality of trenches including the trench, and the plurality of the trenches are formed in a plurality of different regions of the coil pattern.

4. The coil component of claim 3, wherein the plurality of trenches are disposed in symmetrical locations with respect to a center line of a width direction of the body along a length direction of the body.

5. The coil component of claim 3, wherein the plurality of trenches are disposed at asymmetrical locations with respect to a center line of a width direction of the body along a length direction of the body.

6. The coil component of claim 1, further comprising a support member supporting the coil pattern, wherein the trench is formed in one surface of the coil pattern opposing a surface of the coil pattern facing the support member.

7. The coil component of claim 6, wherein the coil portion includes a plurality of coil patterns including the coil pattern, and the plurality of coil patterns are disposed on opposite surfaces of the support member.

8. The coil component of claim 1, wherein the trench is filled with a material constituting the body.

9. The coil component of claim 1, further comprising an insulating layer covering the coil pattern, wherein the trench is filled with a material constituting the insulating layer.

10. The coil component of claim 1, wherein a depth of the trench is a half or less of a thickness of the coil pattern.

11. The coil component of claim 1, wherein an aspect ratio of the coil pattern is 3 to 20.

12. The coil component of claim 11, wherein the coil pattern has a multilayer structure.

13. The coil component of claim 1, wherein the line width of the coil pattern is substantially constant from the uppermost surface of the coil pattern to a lowermost surface of the coil pattern in the thickness direction.

14. A coil component comprising:

a support member; and a coil disposed on a surface of the support member, wherein the coil includes a plurality of trenches disposed in a surface of the coil facing away from the support member and across an entire line width of the coil, wherein at least one of the plurality of trenches extends to the coil in a thickness direction to define a reduced-thickness portion of the coil, and wherein the coil extends without an interface from an uppermost surface of the coil outside the at least one of the plurality of trenches to the surface of the support member.

15. The coil component of claim 14, wherein the coil has a thickness measured orthogonally to the surface of the support member, and a width measured orthogonally to the thickness, and each trench of the plurality of trenches extends through a partial thickness of the coil and through an entire width of the coil.

16. The coil component of claim 15, wherein each trench of the plurality of trenches extends through less than half of a thickness of the coil.

17. The coil component of claim 14, wherein the coil includes a plurality of turns disposed on the surface of the support member, and each trench of the plurality of trenches extends through all turns of the plurality of turns of the coil at locations aligned with each other.

18. The coil component of claim 14, further comprising:

a body comprising a magnetic material dispersed in a resin, wherein the coil is embedded in the body, and the body extends into the trenches of the plurality of trenches.

19. The coil component of claim 14, further comprising:

an insulating layer comprising an insulating material, wherein the coil is embedded in the insulating layer, and the insulating layer extends into the trenches of the plurality of trenches.

20. The coil component of claim 14, wherein the line width of the coil is substantially constant from the surface of the support member to the uppermost surface of the coil in the thickness direction.

* * * * *